United States Patent [19]

Goldfarb et al.

[11] 3,938,277

[45] Feb. 17, 1976

[54] ARTICULATED TOY FIGURE

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif. ; a part interest

[22] Filed: Feb. 19, 1974

[21] Appl. No.: 443,774

[52] U.S. Cl. ..... 46/161

[51] Int. Cl.[2] ..... A63H 3/20

[58] Field of Search ..... 46/161, 22, 130, 131, 133

[56] References Cited

UNITED STATES PATENTS

| | | | |
|---|---|---|---|
| 1,554,535 | 9/1925 | Stroup | 46/161 |
| 1,868,049 | 7/1932 | Deichmann | 46/161 |
| 2,663,971 | 12/1953 | Ippolito | 46/161 |
| 3,221,442 | 12/1965 | Estern et al. | 46/161 X |
| 3,246,422 | 4/1966 | Teagarden | 46/22 |
| 3,740,894 | 6/1973 | Howland et al. | 46/161 |

*Primary Examiner*—Louis G. Mancene
*Assistant Examiner*—J. Q. Lever
*Attorney, Agent, or Firm*—Robert M. Ashen; Robert J. Schaap

[57] ABSTRACT

An articulated toy figure has head, limb, and hip portions each jointed for pivotal motion. The hip portion is formed by a flat plate which is positioned adjacent to the bottom of the figure's torso, and is supported for rotation about the longitudinal axis of the torso. This hip plate has tab means extending normally from the bottom surface thereof, these tab means having knobs extending therefrom over which the upper leg portions fit in pivotal mating engagement. The upper leg portions of the figure, which are joined at one end thereof as just described to the hip plate, and are joined at the other end to the lower leg portions of the figure, have similar recessed joinder portions at each end, these joinder portions having receptacles formed therein into which knobs of the hip plate tab means and lower leg end portions matingly fit for relative pivotal motion.

8 Claims, 7 Drawing Figures

FIG. 1
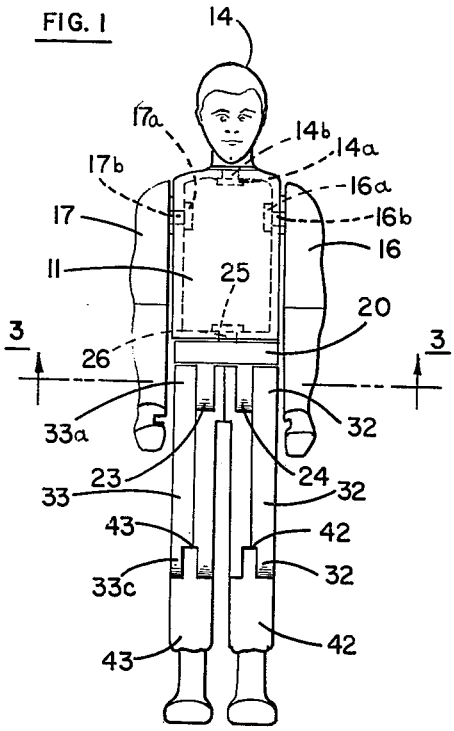
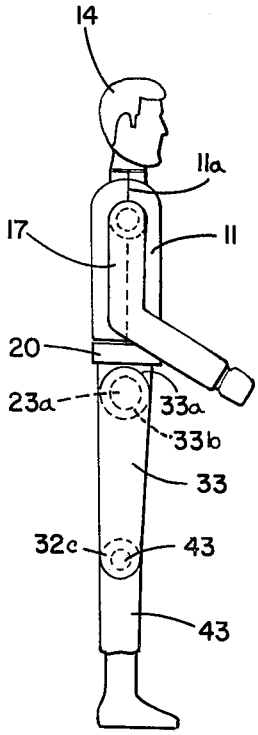
FIG. 2
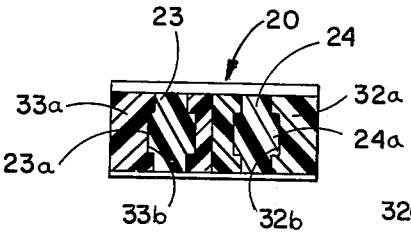
FIG. 3
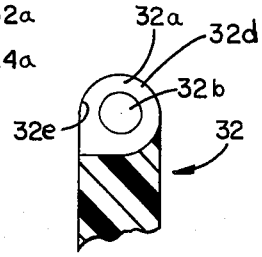
FIG. 5
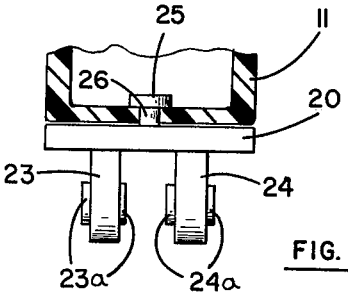
FIG. 4
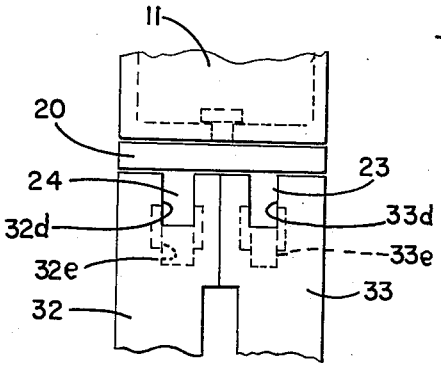
FIG. 6
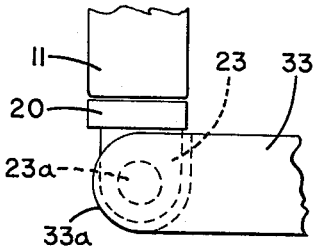
FIG. 7

ARTICULATED TOY FIGURE

This invention relates to articulating toy figures, and more particularly to such a figure having arm, leg, hip and head portions, each attached to the figure for pivotal motion.

Small articulated play figures representing both human and animal characters are used extensively in toy action or adventure play sets to simulate various scenes and activity to provide play activity for children. In simulating various activities, it is desirable to have the figures articulated so that activities such as operating equipment, handling weapons and tools, driving vehicles, etc., can be simulated. The greater the amount of articulation, the more versatile the figure becomes, thereby enhancing its play value.

Highly articulated miniature play figures of the prior art tend to be overly expensive in their construction which mitigates against their use in inexpensive play sets, except in very limited numbers. Further, many play figures having a high amount of articulation tend to be somewhat fragile in their construction with a resultant short life, particularly in the hands of smaller children.

The toy figure of this invention overcomes the aforementioned shortcomings of prior art devices in providing a figure having a high amount of articulation and at the same time a relatively simple and economical construction. Further, the toy figure of this invention is highly durable in its construction such that breakage of the articulated parts, particularly at their joints, is minimized.

It is therefore an object of this invention to provide an articulated toy figure having a high degree of articulation which is of more simple and economical construction.

It is a further object of this invention to provide a highly articulated toy figure of a more ruggedized construction.

Other objects of the invention will become apparent as the description proceeds in connection with the accompanying drawings, of which:

FIG. 1 is a front elevational view of one embodiment of the invention;

FIG. 2 is a side elevational view of the embodiment of FIG. 1;

FIG. 3 is a cross sectional view taken along the plane indicated by 3—3 in FIG. 1;

FIG. 4 is an elevational view illustrating the details of the hip portion of the preferred embodiment;

FIG. 5 is an elevational view illustrating one of the knee joints of the preferred embodiment;

FIG. 6 is a rear elevational view of the hip portions of the preferred embodiment; and FIG. 7 is a side elevational view of the hip portions of the preferred embodiment with the legs in a "seated" position.

Briefly described, the toy figure of the invention is as follows: A figure has a torso portion with a head, a pair of arms and a hip plate member attached thereto, each for pivotal motion about one axis. In the preferred embodiment, such attachment is achieved by means of circular knobs which are fitted into the hollow center of the torso. The hip plate member is in the form of a flat plate which abuts against the bottom portion of the torso and pivots about the longitudinal axis thereof. The hip plate has tab means extending downwardly therefrom, the upper leg portions having recessed ends which fit over the tab means for pivotal motion thereon. Finally, knee joints are formed for the lower leg portions by means of joint structure similar to that for joining the upper legs to the hip plate.

Referring now to the Figures, one embodiment of the invention is illustrated. The figure, which may be made of plastic or any other suitable material, includes a block shaped torso 11. A head 14 is pivotally attached to torso 11 by means of circular knob 14*a* which is connected to head 14 by pin 14*b* and fits into the hollow center portion of the torso. Head 14 thus can be fully rotated about the longitudinal axis of the torso.

Arms 16 and 17 are each pivotally attached to torso 11 for motion about an axis normal to the longitudinal axis of the torso by means of knob portions 16*a* and 17*a* which are retained in the hollow center portion of the torso and are joined to arms 16 and 17 by pin portions 16*b* and 17*b* respectively. Hip plate portion 20 comprises a flat plate having tab means in the form of a pair of tabs 23 and 24 extending normally from one surface thereof and a knob 25 connected to the other surface thereof by means of pin 26. Plate 20 is thus pivotally retained on the torso 11 by means of knob 25 for rotation about the longitudinal axis of the torso. Torso 11 may be fabricated in two pieces which are joined together along longitudinal seam 11*a*, as shown in FIG. 2, thus facilitating the assembly of the device, with the arms, head and hip portions joined to the torso for pivotal motion relative thereto as just described. Tabs 23 and 24 each have knob portions 23*a* and 24*a* respectively, over which bifurcated or recessed end portions 32*a* and 33*a* of legs 32 and 33 respectively fit for pivotal motion, as now to be described.

Referring now additionally to FIGS. 3 and 5–7 (FIG. 5 showing one of the legs 32), the end portions 32*a* and 33*a* of the legs are rounded to simulate the human rump. End portions 32*a* and 33*a* have receptacles 32*b* and 33*b* respectively formed therein, the knob portions 24*a* and 23*a* respectively fitting into these receptacles. The legs 32 and 33 thus can be pivoted about tabs 24 and 23 respectively, with the legs being stopped in abutment against plate 20 in an outwardly extending position parallel to the surface of the plate to provide a sitting position for the figure as shown in FIG. 7. Knee joints are formed to join lower leg portions 42 and 43 to upper leg portions 32 and 33 respectively in the same general manner as just described for the joinder of leg portions 32 and 33 to the hip plate tabs 24 and 23. These knee joints are formed by bifurcated end portions 32*c* and 33*c* which fit over the reduced end portions 42*a* and 43*a* of the lower legs, the ends of these legs 42*a* and 43*a* having knobs as shown at 43*b* in FIG. 2 which fit into mating receptacles in bifurcated portions 32*c* and 33*c*, in the same manner as described in connection with bifurcated portions 32*a* and 33*a*.

As shown in FIG. 6, the slots 32*d* and 33*d* at the rear of the upper legs are shorter than the slots 32*e* and 33*e* at the front of the legs. This provides limited rearward leg movement, yet allows the legs to move forwardly to the fully extended position (as shown in FIG. 7).

The toy figure of the invention thus includes a number of articulated members enabling the simulation of a great variety of poses. The joints for these body portions are implemented in a manner which lends itself to simple and economical construction. Further, the construction of the device lends itself to rough handling.

While the invention has been described and illustrated in detail, it should be clearly understood that this is by way of illustration and example only and is not to be taken by way of limitation, the spirit and scope of the invention being limited only by the terms of the following claims.

We claim:

1. A toy figure comprising:

a three dimensional torso portion having a longitudinal axis extending generally vertically, said torso portion having an upper end and a lower end which defines a generally flat downwardly facing contact surface, a head portion supported at said upper end of said torso portion, a pair of arm portions pivotally attached to said torso portion, a hip plate portion attached to said lower end of said torso portion for pivotal motion about the longitudinal axis of said torso portion, said hip plate portion being in the form of a flat plate having a power surface and a generally flat upper contact surface, said flat plate extending transversely to said torso axis with said plate upper contact surface juxtaposed to and in slidable mating contact with said torso portion lower end contact surface, said plate having tab means extending downwardly from the lower surface thereof, one of the downwardly facing contact surfaces of said torso portion and the upper contact surface of said plate having a locking recess therein and the other thereof having a locking knob extended into and locked within the recess to permit pivotal motion of the hip plate portion relative to the longitudinal axis of the torso portion, and a pair of leg portions pivotally attached to said tab means.

2. The toy figure of claim 1 wherein each of said leg portions includes an upper and a lower leg portion pivotally attached to each other.

3. The toy figure of claim 1 wherein the ends of said leg portions are recessed, said recessed ends fitting over said tab means, said tab means having knobs extending outwardly therefrom, said recessed ends of said leg portions having receptacles formed therein into which said knobs fit.

4. The toy figure of claim 3 wherein said recessed portions define slots which are greater in extent on one side thereof than on the opposite side thereof, thereby limiting relative motion between said leg portions and said hip plate greater in one direction than the direction opposite to said one direction.

5. The figure of claim 1 wherein said head portion is pivotally movable about the longitudinal axis of said torso portion, said torso portion has a hollow interior, the head, arms and hip plate portions each having a knob extending therefrom for retaining said portions to said torso portion, said knobs being fitted within the interior of said torso portion.

6. The figure of claim 3 wherein the ends of the leg portions are rounded and form slots into which the tab means are fitted, said slots being greater in extent on the side thereof facing on the front of the figure than the side thereof facing on the rear of the figure, thereby permitting greater pivotal motion of said leg portions to the front than the rear.

7. A toy figure comprising:

a three-dimensional torso portion having an upper end and a lower end and a hollow interior, said torso portion also having a generally vertically extending longitudinal axis and said lower end defines a generally flat downwardly facing contact surface, a head portion supported at the upper end of said torso portion, said head portion having a knob extending from a lower portion to permit pivotal movement of said head portion about a generally vertical longitudinal axis of said torso portion, a pair of arm portions being pivotally attached to said torso portion, each of said arm portions having a locking knob extending therefrom and being fitted within the interior of said torso portion to permit movement of said arm portions in an axis relatively normal to said longitudinal axis of said torso portion, a hip plate portion attached to the lower end of said torso portion for pivotal movement about the longitudinal axis of said torso portion, said hip plate portion being in the form of a flat plate extending transversely to said torso axis and having a lower surface and a generally flat upper contact surface in slidable mating contact with the lower contact surface on said torso portion, the upper contact surface of said plate having an outwardly extending knob fitted within the interior of said torso portion to permit pivotal movement of said hip plate portion about an axis transverse to the longitudinal axis of said torso portion, tab means extending downwardly from the lower surface of said flat plate, a pair of upper leg portions pivotally attached at their upper ends to said tab means, said upper ends of said leg portions being recessed with receptacles formed therein, said tab means having knobs extending outwardly therefrom and said knobs on said tab means extending into and being fitted into said recesses, the upper ends of said leg portions being rounded, said recesses defining slots which are greater in extent on the side thereof facing the front of the figure than on the side thereof facing the rear of the figure, thereby permitting greater pivotal motion of the upper leg portions to the front than to the rear, and lower leg portions pivotally attached to each of said upper leg portions.

8. A toy figure comprising:

a three-dimensional block shaped torso portion comprised of first and second torso sections and each of said sections having opposed seam lines which are secured together to form said block shaped torso portion, said torso portion having a hollow interior and an upper end and a lower end and side walls, said torso portion also having a generally vertically extending longitudinal axis with said lower end defining a generally flat downwardly facing contact surface, a head portion supported at the upper end of said torso portion, said head portion having a circular head knob extending from a lower portion thereof and being secured to said head portion by a head pin, said head knob being fitted within the interior of said torso portion through an aperture on the upper end of said torso portion to permit pivotal movement of said head portion about said generally vertical longitudinal axis of said torso portion, a pair of arm portions being pivotally attached to said torso portion, each of said arm portions having a circular locking arm knob extending therefrom and being secured thereto through arm pins, said arm knobs being fitted within the interior of said torso portion through apertures on said side walls to permit movement of said arm portions in an axis relatively normal to said longitudinal axis of said torso portion, a hip plate portion attached to the lower end of said torso portion for pivotal movement about the longitudinal axis of said torso portion, said hip plate portion being in the form of a flat plate extending transversely to said torso axis and having a lower surface and a generally flat upper contact surface in slidable mating contact with the lower contact surface on said torso portion, the upper contact surface of said plate having an outwardly extending circular hip knob secured to said plate through a hip plate, said hip knob extending through an aperture in the lower end of said torso portion and being fitted within the interior of said torso portion to permit pivotal movement of said hip plate portion about an axis transverse to the longitudinal axis of said torso portion, tab means extending downwardly from the lower surface of said flat plate, a pair of upper leg portions pivotally attached at their upper ends to said tab means, said upper ends of said leg portions having rounded ends somewhat similar to the rump of a human being and also being recessed with receptacles formed therein, said tab means having circular leg knobs extending outwardly therefrom, and said knobs on said tab means being secured thereto by leg pins and extending into and being fitted into said recesses, said recesses defining slots which are greater in extent on the side thereof facing the front of the figure than on the side thereof facing the rear of the figure, thereby permitting greater pivotal motion of the upper leg portions to the front than to the rear, and lower leg portions pivotally attached to each of said upper leg portions.

* * * * *